US006530415B2

(12) United States Patent
Wu

(10) Patent No.: US 6,530,415 B2
(45) Date of Patent: Mar. 11, 2003

(54) FORCE REDUCING DEVICE AND METHOD FOR ADJUSTING SHUTTER ROPES

(76) Inventor: Chia-Tien Wu, 6F-1, No. 30 Lin Sen Rd., Taichung (TW)

( * ) Notice: Subject to any disclaimer, the term of this patent is extended or adjusted under 35 U.S.C. 154(b) by 0 days.

(21) Appl. No.: 09/877,049

(22) Filed: Jun. 11, 2001

(65) Prior Publication Data

US 2002/0185236 A1 Dec. 12, 2002

(51) Int. Cl.[7] ..... E06B 9/30
(52) U.S. Cl. ..... 160/168.1 R
(58) Field of Search ..... 160/168.1 R, 173 R, 160/172 R, 176.1 R, 177 R, 178.1 R, 405

(56) References Cited

U.S. PATENT DOCUMENTS 2,055,826 A * 9/1936 Nottingham ..... 160/168.1 R
2,072,835 A * 3/1937 Dodge ..... 160/168.1 R
2,616,496 A * 11/1952 Junkunc ..... 160/173 R
2,660,238 A * 11/1953 Wright et al. ..... 160/173 R
4,177,853 A * 12/1979 Anderson et al. ..... 160/168.1 R
4,487,243 A * 12/1984 Debs ..... 160/168.1 R
4,621,673 A * 11/1986 Georgopoulos et al. . 160/168.1 R
4,637,445 A * 1/1987 Nilsson ..... 160/168.1 R
5,927,365 A * 7/1999 Almodovar et al. .. 160/168.1 R
6,047,760 A * 4/2000 Judkins ..... 160/168.1 R

* cited by examiner

*Primary Examiner*—David M. Purol
(74) *Attorney, Agent, or Firm*—Rosenberg, Klein & Lee

(57) ABSTRACT

A force reducing device and method for adjusting shutter ropes is provided wherein winding boxes are divided into two sets. Two winding box winding box sets are symmetrically disposed with respect to a center of the upper beam, and each winding box set is fixed with a rope. The two ropes pass through respective holes in the slats, and then wind through a first pulley on the lower beam, and then extend and wind through a second pulley. The two ropes pass upwardly through the respective hole in the slats. Then, the two ropes pass through the outlets of the balance strip and are combined as a first combined rope. The first combined rope passes through an opening of the rope retaining seat to be combined with opposing ends of another rope.

9 Claims, 5 Drawing Sheets

FORCE REDUCING DEVICE AND METHOD FOR ADJUSTING SHUTTER ROPES

FIELD OF THE INVENTION

The present invention relates to a force reducing device for adjusting shutter ropes, wherein, in addition to pulling a shutter with less force, the shutter can be assembled easily.

BACKGROUND OF THE INVENTION

Shutters of large size cannot be used to replace cloth window curtains due to the large force necessary to operate the rope of the shutters. The current force reducing device for shutters has pulleys in the lower beam thereof. The ropes pass through the same holes in the slats, so that the holes must be elongated. In addition to being difficult to assemble, the strength of each of the slats is weakened. In order to reduce the required force, the length of the rope must be elongated in an inverse ratio to the amount of fore reduction. However, a long rope spoils the appearance of the shutters. Furthermore, the operation of those shutters is inconvenient.

SUMMARY OF THE INVENTION

Accordingly, the primary object of the present invention is to provide a force reducing device for adjusting shutter ropes, wherein, in addition to pulling shutter ropes with less force, the shutters can be assembled easily.

To achieve that object, the present invention provides a force reducing device, for adjusting shutter ropes and the method thereof.

An upper beam is embedded with a plurality of pulley boxes, a slat angle drive, a plurality of winding boxes and a rope retaining seat. Each winding box has a rolling shaft. The rope retaining scat has a balance strip. A lower beam has a plurality of holes and a plurality of pulleys. A plurality of slats each have holes formed therethrough. The winding boxes are divided into two sets. The two winding box sets arc symmetrically arranged with respect to a center of the upper beam, and each winding box set is fixed with a respective rope. The two ropes pass through respective holes in the slats, and then wind through a first pulley on the lower beam. Then, the ropes extend and wind through a second pulley of the same set with the first pulley on the lower beam. The two ropes then pass upwards through the respective holes on the slats, and then pass through the upper sides of a rolling shaft below the winding boxes. The two ropes pass through outlets at an upper and a lower side of the balance strip, and then the two ropes arc combined as a first combined rope. Then, the first combined rope passes through an opening at another side of the rope retaining seat to be coupled to opposing ends of another rope to form a second combined rope. When the second combined rope is pulled, one end of the rope will lift the shutter, and another end of the rope will be received in an inner space of the upper beam.

The various objects and advantages of the present invention will be more readily understood from the following detailed description when read in conjunction with the appended drawings.

DETAILED DESCRIPTION OF THE PREFERRED EMBODIMENTS

Figure 2:
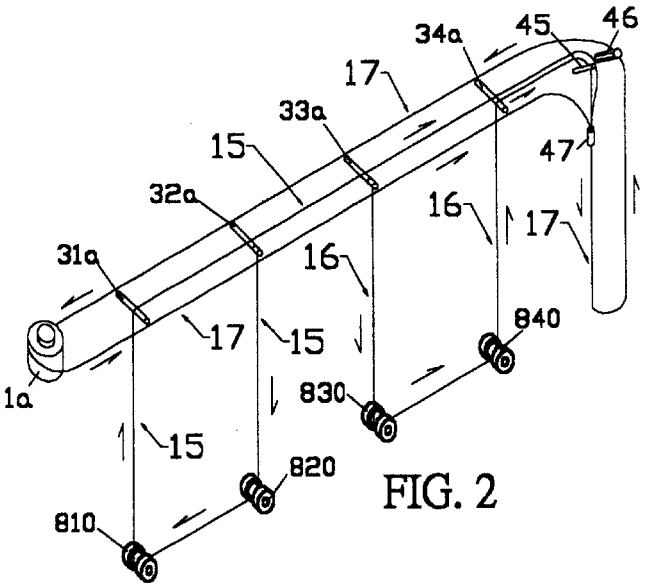
FIG. 2 is a schematic view of the path of the rope of FIG. 1.

In order that those skilled in the art can further understand the present invention, the invention will be described in the following detailed description. However, these description and the appended drawings are provided to aid those skilled in the art to understand the objects, features, and characteristics of the present invention, but should not be used to confine the scope and spirit of the present invention defined in the appended claims.

Referring to FIGS. 1, 2, 16A, 16B, 17A, 17B, 18A, 18B, 19A and 19B, the upper beam 5 is sequentially embedded with a pulley box 1, a slat angle drive 2, a winding box 31, a winding box 32, a winding box 33, a winding box 34, and a rope retainer 4. The pulley box 1 is installed with a pulley 1*a*. The slat angle drive has a guide groove 21, a guide groove 22, a hook 23, a rotary rod 24 and a link shaft 25 penetrating through the winding box 31, winding box 32, winding box 33 and winding box 34.

The winding box 31 is installed with a guide groove 311, a guide groove 312, a guide groove 313, and a rolling shaft 31*a*. The winding box 32 is installed with a guide groove 321, guide groove 322, guide groove 323, and rolling shaft 32*a*. The winding box 3 is installed with a guide groove 331, a guide groove 332, a guide groove 333, and a rolling shaft 33*a*. The winding box 34 is installed with a guide groove 341, a guide groove 342, a guide groove 343, and a rolling shaft 34*a*.

The rope retainer 4 is formed with an opening 41, and an opening 42, a balance strip 43, an outlet 44, a fixing wheel 45 and a fixing wheel 46.

The ladder rope 11, ladder rope 12, ladder rope 13 and ladder rope 14 respectively pass by the slats 61, 62, 63, 64, 65 and 66. The upper ends of the ladder rope 11, ladder rope 12, ladder rope 13 and ladder rope 14 respectivcly pass through the hole 5*a*, hole 5*c*, hole 5*d*, hole 5*f*, hole 5*g*, hole 5*i*, hole 5*j* and hole 51 of the upper beam 5 to be respectively fixed to the winding box 31, winding box 32, winding box 33, and winding box 34. The lower ends thereof are fixed to the holes of the lower beam 7*x* corresponding to the winding box 31, winding box 32, winding box 33, and winding box 34, by the plug 91, plug 92, plug 93 and plug 94. The shaft 811, shaft 821, shaft 831, and shaft 841 pass through the pulley 810, pulley 820, pulley 830, and pulley 840 and are fixed to the lower beam 7*x*.

The winding box 31 and winding box 32 define one set and winding box 33 and winding box 34 define another set. The rope 15 is fixed to the rolling shaft 32*a* of the winding box 32 and then passes downwards through the hole 5*e* and openings in the slat 61, slat 62, slat 63, slat 64, slat 65 and slat 66, at positions corresponding to the hole 5*e*. Then, it winds through the right side of the pulley 820 in the lower beam 7*x* and then passes over pulley 810 and through respective holes in the slat 61, slat 62, slat 63, slat 64, slat 65 and slat 66 corresponding to the hole 5*b*. Then the rope passes through the hole 5*b* to the rolling shaft 31*a*, guide groove 313, guide groove 323, guide groove 333, and guide groove 343 to the outlet 44 of the rope retaining seat 4. The rope 16 is fixed to the rolling shaft 33*a* of the winding box 33, and then passes through the holes 5*h* and corresponding holes of slat 61, slat 62, slat 63, slat 64, slat 65 and slat 66. Then, it passes over the left side of the pulley 830 on the lower beam 7*x* to the right side of the pulley 840. The rope 16 then passes upwards through corresponding holes of the slat 61, slat 62, slat 63, slat 64, slat 65 and slat 66, and through the hole 5*k*. Then, the rope 16 passes through the rolling shaft 34*a*, and guide groove 343 of the winding box 34 to the outlet 44 of the rope retaining seat 4.

The rope 15 and rope 16 are combined and fixed together external to the outlet 44. The extension of the combined ropes 15 and 16 are combined with a rope 17. The rope 17 passes through the opening 42 to enter into the upper beam 5. Then it passes through the guide groove 341, guide groove 331, guide groove 321, guide groove 311, and guide groove 21 to pass over the pulley 1*a* and then it passes through the guide groove 22, guide groove 312, guide groove 322, guide groove 332, and guide groove 342. Then, the rope 17 passes out through the opening 41 and passes through the fixing ring 47 with the opposing end of the rope 17 and ropes 15 and 16, and is combined therewith.

When the fixing ring 47 or the rope 17 below the fixing ring 47 is pulled leftwards and downwards, the rope 15, rope 16 and rope 17 are also pulled. The rope 15 and 16 lift the lower beam (shutter) upwards. The rope 17 stores the rope 15 and rope 16 in the inner space of the upper beam 5, along the periphery of the upper beam 5. If the rope 17 is released rightwards and upwards, then the rope 15 and rope 16 are buckled between the fixing wheel 45 and fixing wheel 46. Therefore, in addition to force being reduced and being easily assembled, the rope is stored.

Figure 4:
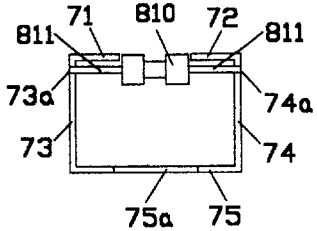
FIG. 4 is a left side view of FIG. 3.
Figure 3:
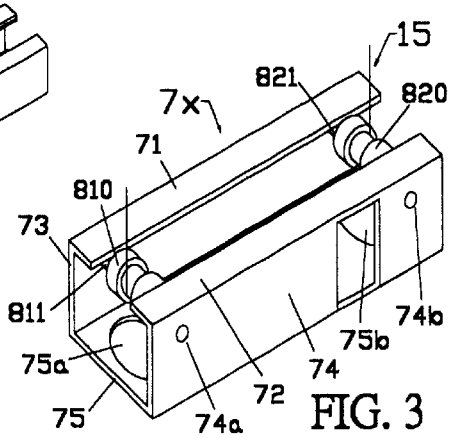
FIG. 3 is a schematic perspective view showing that two pulleys of the lower beam of FIG. 1 are formed as one set.

With reference to FIGS. 3 and 4, in the lower beam 7*x* the pulley 810 and pulley 820 define one set and are installed with an upper left panel 71, an upper right panel 72, a left panel 73, a hole 73*a*, a right panel 74, a hole 74*a*, a hole 74*b*, a hole 75*a*, and a hole 75*b*. The shaft 811 and shaft 821 respectively pass through the pulley 810 and pulley 820 to be fixed to the lower beam 7*x*. The rope 15 winds downwards over the right side of the pulley 820 and upwards from the left side of the pulley 810. The hole 75*a* and hole 75*b* on the bottom plate 75 respectively receive plug 91 and plug 92 therein to fix the ladder rope 11 and ladder rope 12 in the lower beam 7*x*. The upper left panel 71 and upper right panel 72 can support the weight of the slat 61, slat 62, slat 63, slat 64, slat 65 and slat 66 without deformation.

Referring to FIGS. 5, 6, 7A and 7B, FIG. 5 is an exploded perspective view of the second preferred embodiment of the present invention. The difference of this embodiment from the first embodiment is that the structure of the lower beam 7*y* is different from the lower beam 7*x*, while the other parts are identical.

In the lower beam 7*y*, the pulley 810 and pulley 820 are formed as one set and have an upper left panel 7*a*, a flange 7*a*1, an upper right panel 7*b*, a flange 7*b*1, a middle plate 7*e*, a bottom plate 7*d*, a hole 7*d*1, a hole 7*d*2, plug 71*a*, a flange 71*a*1, a plug 71*b*, a flange 71*b*1, an opening 714, and opening 715, a plug 72*a*, a flange 72*a*1, a plug 72*b*, a flange 72*b*1, an opening 724, and an opening 725. The rope 15 passes downwards through the right side of the pulley 820 and then passes upwards from the left side of the pulley 810. The hole 7*d*1 and hole 7*d*2 on the bottom plate 7*d* respectively receive the plug 91 and plug 92 to fix the ladder rope 11 and ladder rope 12 in the lower beam 7*y*. The upper left panel 7*a* and upper right panel 7*b* can support the weight of the slat 61, slat 62, slat 63, slat 64, slat 65 and slat 66 without deformation. In addition to increasing the strength of the lower beam 7*y*, the middle plate 7*c* has the function of fixing the plug 71*a*, plug 71*b*, plug 72*a* and plug 72*b*.

In assembly, the shaft 811 and shaft 821 pass through the pulley 810 and pulley 820 and then enters into the lower side of the upper left panel 7*a* and upper right panel 7*b* through the opening 714, opening 715, opening 724 and opening 725. Then, the plug 71*a*, plug 71*b*, plug 72*a* and plug 72*b* are each respectively inserted into the opening 714, opening 715, opening 724 and opening 725. Thc flange 7*a*1, flange 7*b*1, flange 71*a*1, flange 71*b*1, flange 72*a*1, and flange 72*b*1 servo to retain the shaft 811 and shaft 812 in proper positions in the lower beam 7*y*.

The shaft 831 and shaft 841 respectively pass through the pulley 830 and pulley 840 and enter into the lower beam 7*y* to form another set. The structure is identical to the set formed by the pulley 8 10 and the pulley 820.

Figure 8:
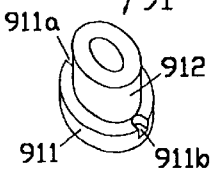
FIG. 8 is a schematic pcrspective view of a plug.
Figure 5:
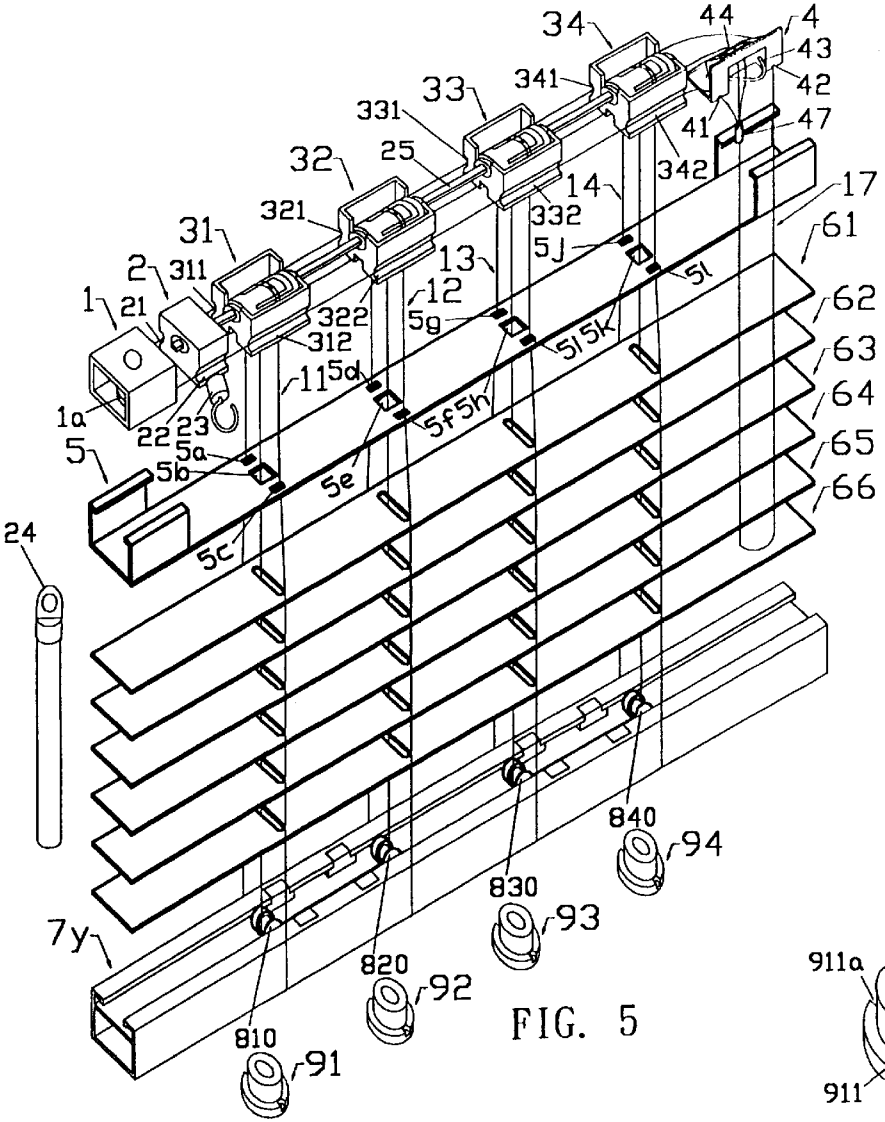
FIG. 5 is an exploded perspective view of the second preferred embodiment of the present invention.
Figure 10:
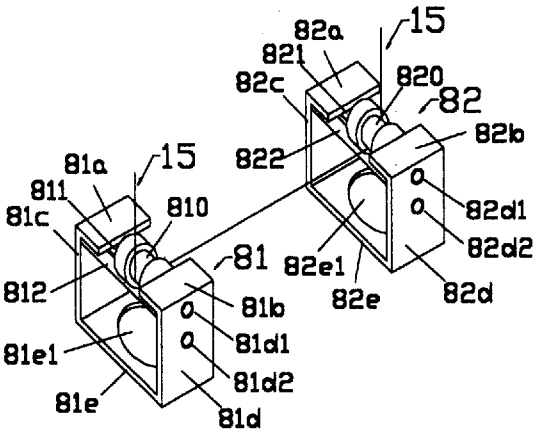
FIG. 10 is a schematic perspective view showing that two coupling means of FIG. 9 are formed as one set.
Figure 11:
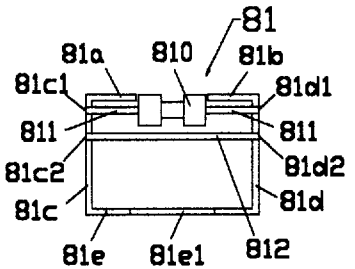
FIG. 11 is a left side view of the coupling means in the third embodiment.

As shown in FIG. 8, a schematic perspective view of the plug 91 is illustrated. The plug 91 has a round cylinder 911, a groove 911*a*, a groove 911*b*, and a round sleeve 912. The structures of the plug 92, plug 93, and plug 94 are identical to that of the plug 91.

Figure 1:
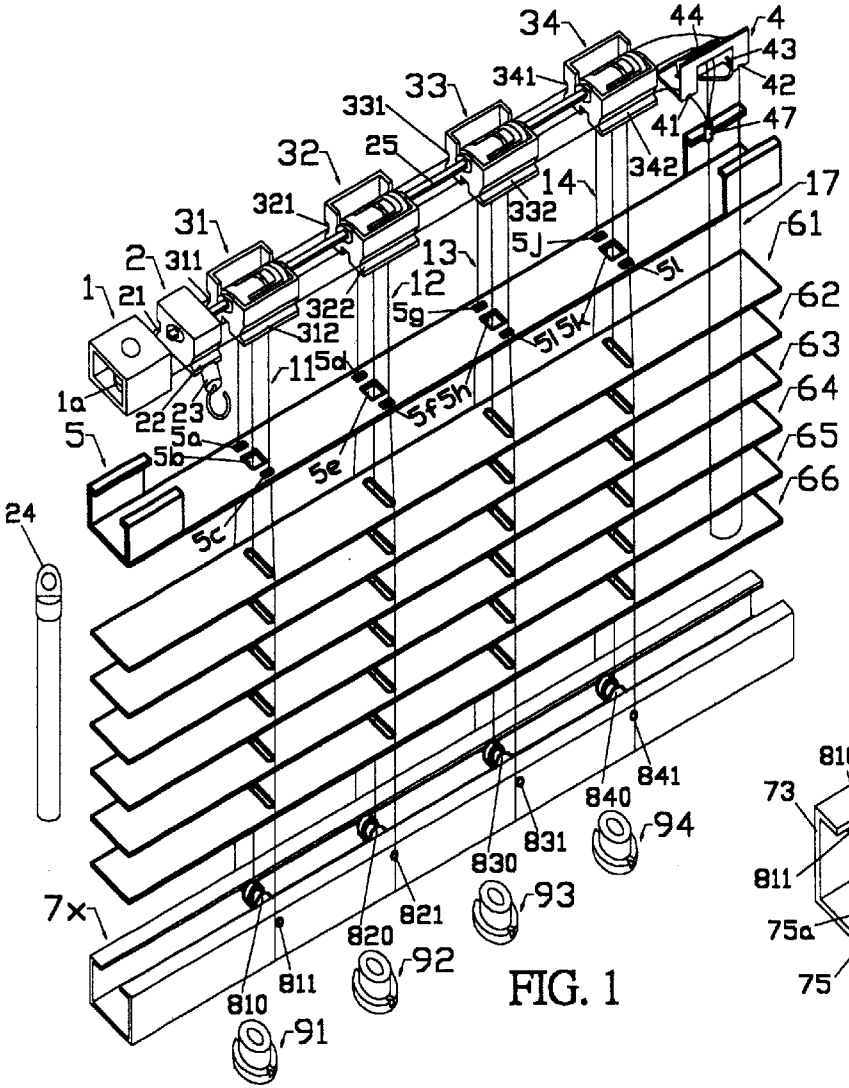
FIG. 1 is an exploded perspective view of a first preferred embodiment of the present invention.
Figure 6:
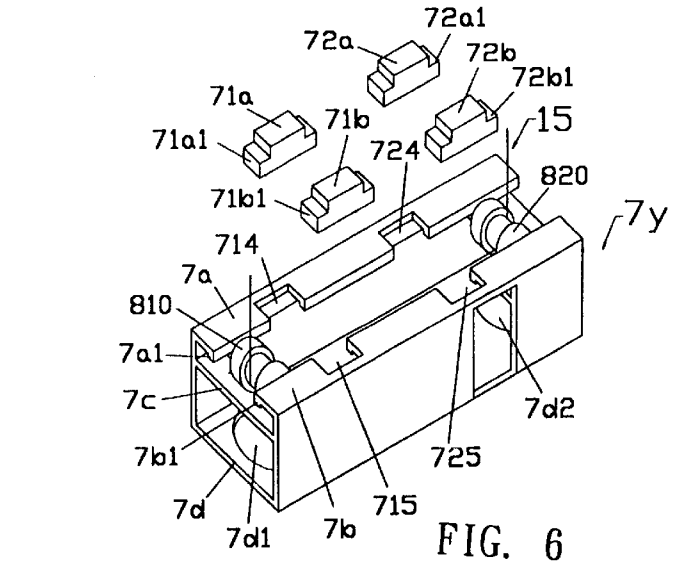
FIG. 6 is a schematic perspective view showing that two pulleys of the lower beam of FIG. 5 arc formed as one set.
Figure 7B:
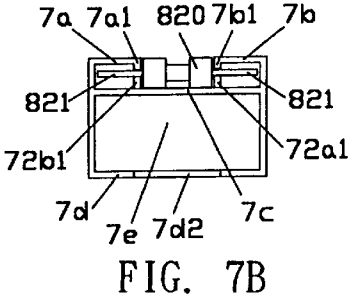
FIG. 7B shows a right side view of FIG. 6.
Figure 7A:
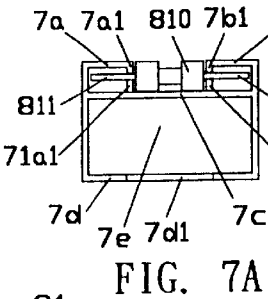
FIG. 7A shows a left side view of FIG. 6.

Referring to FIGS. 9, 10, 11, and 12, FIG. 9 is an exploded perspective view of another preferred embodiment of the present invention. The difference of FIG. 9 from the first embodiment illustrated in FIG. 1 is that the lower beam 7 has a coupling means 81, a coupling means 82, a coupling means 83 and a coupling means 84 which are coupled thereon. The other parts are identical.

In the lower beam 7, the coupling means 81 and the coupling means 82 are formed as at set and have a pulley 810, a shaft 811, a shaft 812, an upper left panel 81*a,* an upper right panel 81*b,* a left panel 81*c,* a hole 81*c*1, a hole 81*c*2, a right panel 81*d,* a hole 81*d*1, a hole 81*d*2, a bottom plate 81*e,* a hole 81*e*1, a pulley 820, a shaft 821, a shaft 822, an upper left panel 82*a,* an upper right panel 82*b,* a left panel 82*c,* a right panel 82*d,* a hole 82*d*1, a hole 82*d*2, a bottom plate 82*e,* a hole 82*e*1, etc. The bottom of the lower beam 7 has a hole 713, a hole 723, a hole 733 and a hole 743 with respect to a coupling means 81, a coupling means 82, a coupling means 83 and a coupling means 84. The hole 713 and hole 723 are respectively located with respect to the hole 81*e*1, and the hole 81*e*2 on the bottom plate 81*e* and bottom plate 82*a,* at the bottom of the coupling means 81 and coupling means 82. The holes 713 and 723, and holes 81*c*1 and 81*c*2 can respectively receive the plug 91*a* and plug

92*a,* so that the ladder rope 11 and ladder rope 12 are fixed in the lower beam 7, and the coupling means 81 and coupling means 82 are fixed on the lower beam 7. The shaft 811 and shaft 821 respectively pass through the pulley 810 and pulley 820 and then are fixed to the coupling means 81 and coupling mcans 82. The rope 15 winds through the right side of the pulley 820 and then passes upwards from the left side of the pulley 810. The shaft 812 penetrates through the hole 81*d*1 and hole 912*a,* hole 81*c*2 and the lower beam 7 for enhancing the coupling between the coupling means 81 and lower beam 7. Similarly, the coupling means 82, coupling means 83 and coupling means 84 have respective shafts passing through the lower beam 7, plug 92*a,* plug 93*a* and plug 94*a* to enhance the coupling between the coupling means 82, coupling means 83, coupling means 84 and lower beam 7.

The upper left panel 81*a,* upper right panel 81*b,* upper left panel 82*a,* and upper right panel 82*b* can support the weights of the slat 61, slat 62, slat 63, slat 64, slat 65 and slat 66 without deformation.

The coupling means 83 and coupling means 84, which are formed as another set, have the same structure, and principle as the set formed by the coupling means 81 and coupling means 82.

Figure 12:
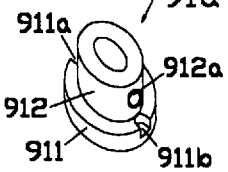
FIG. 12 is a schematic perspcctive view of the plug in the third embodiment.
Figure 9:
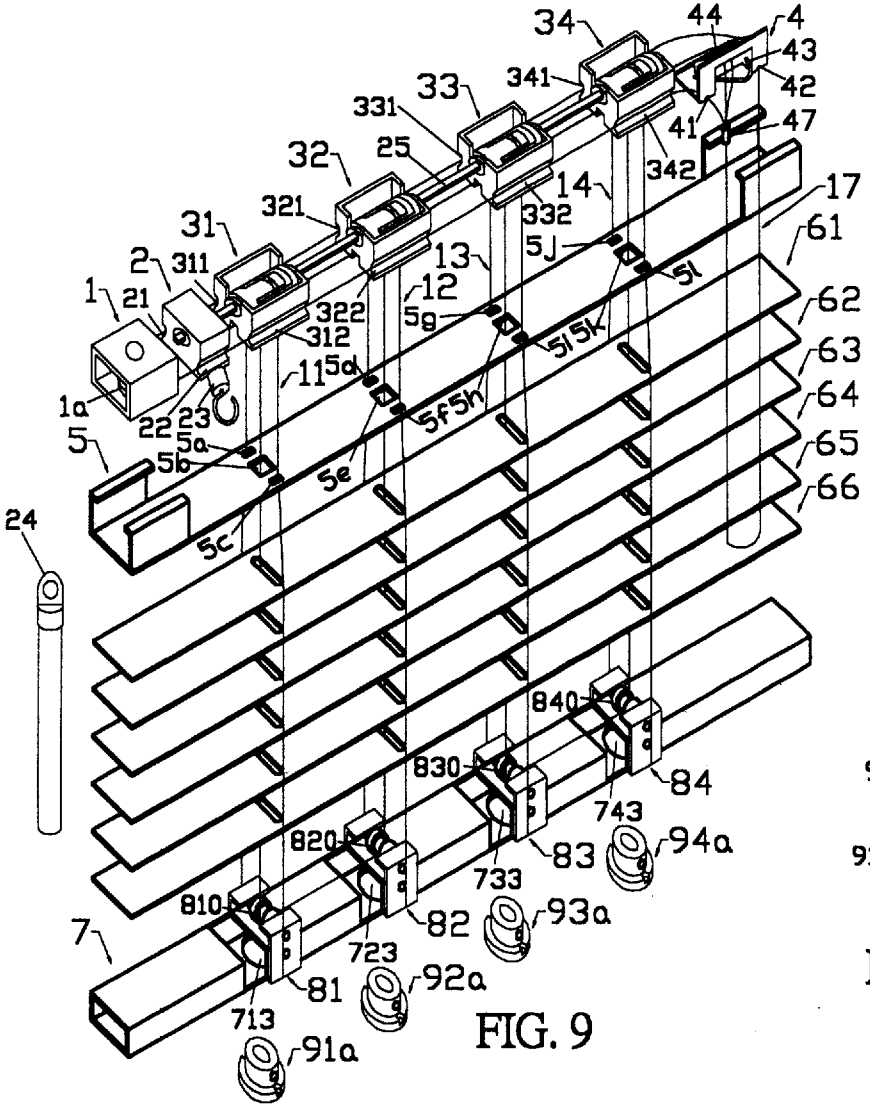
FIG. 9 is an exploded cross sectional view of the third preferred embodiment of the present invention.
Figure 14:
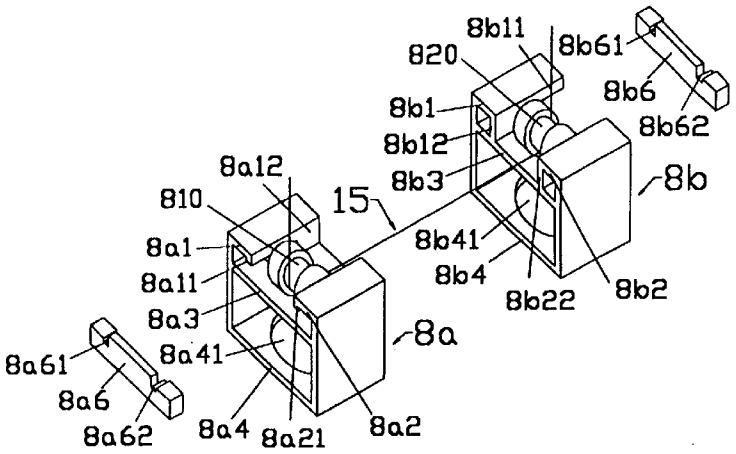
FIG. 14 is a schematic perspective view showing that two coupling means of FIG. 13 are formed as one set.
Figure 15B:
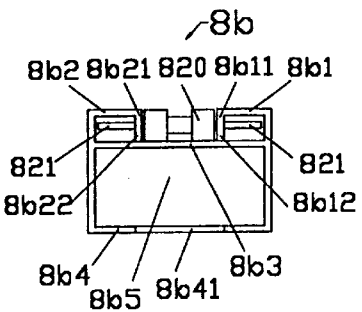
FIG. 15B is a right side view of another coupling means in the fourth embodiment.
Figure 15A:
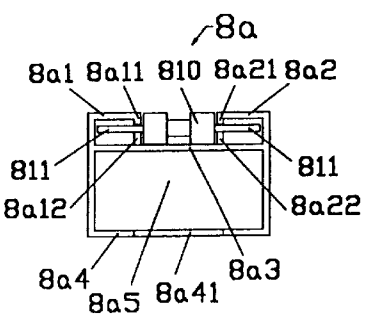
FIG. 15A is a left side view of a coupling means in the fourth embodiment.
Figure 13:
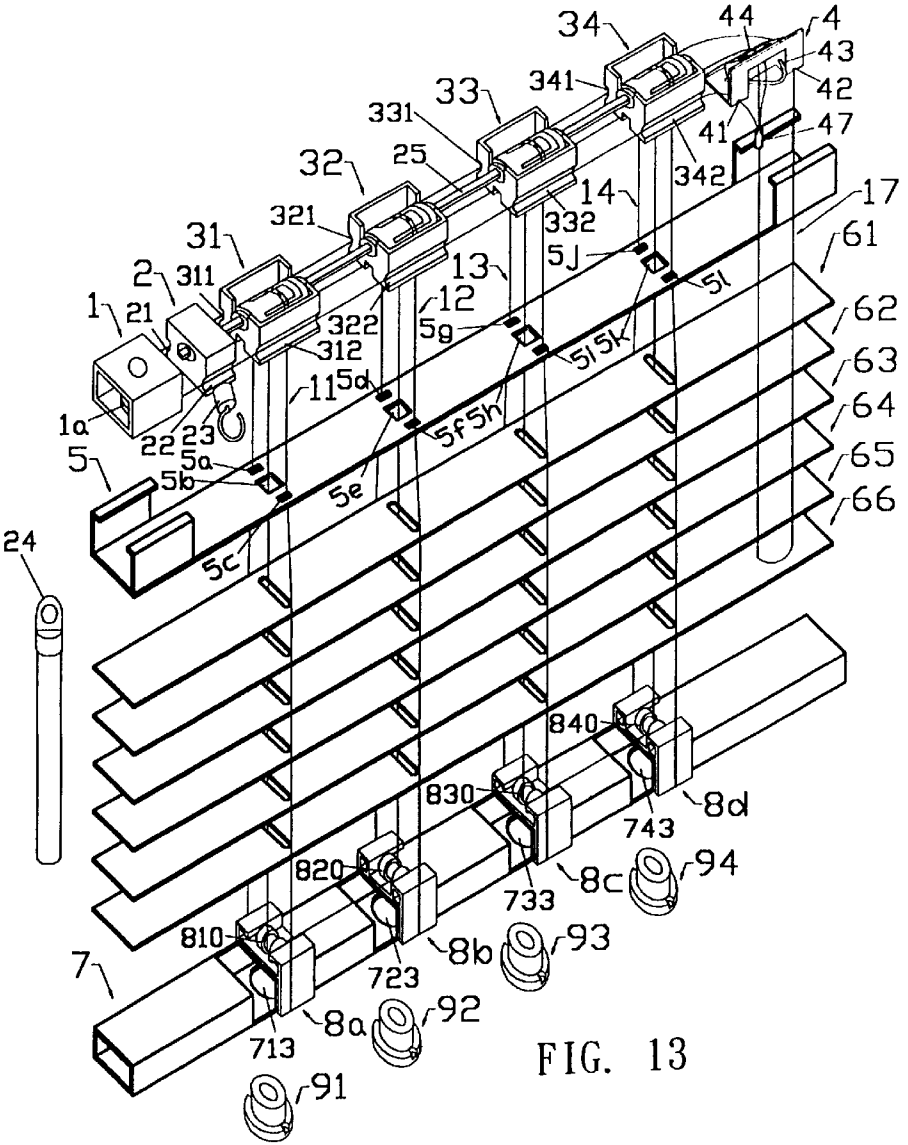
FIG. 13 is an exploded schematic view of the fourth preferred embodiment of the present invention.
Figure 18A:
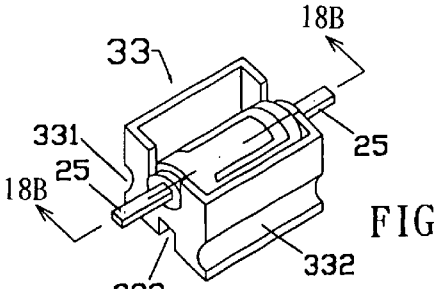
FIG. 18A is a perspective view of a winding box 33 of the present invention.
Figure 18B:
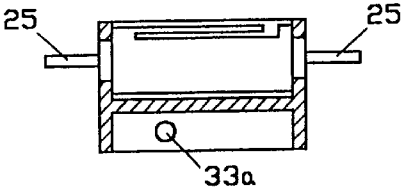
FIG. 18B is a schematic cross sectional view along line 18B—18B of the winding box 33 of FIG. 18A.
Figure 17A:
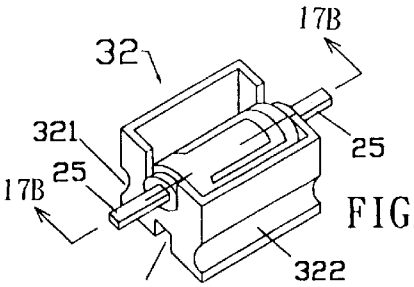
FIG. 17A is a perspective view of a winding box 32 of the present invention.
Figure 17B:
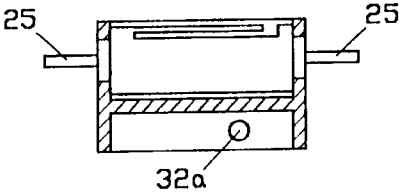
FIG. 17B is a schematic cross sectional view along line 17B—17B of the winding box 32 of FIG. 17A.

FIG. 12 is a schematic perspective view of the plug 91*a*. The plug 91*a* has a round cylinder 911, a groove 911*a,* groove 911*b,* a round sleeve 912, and a hole 912*a*. The hole 912*a* penetrates through the round sleeve 912. The structures of the plug 92*a,* plug 93*a,* and plug 94*a* are identical to that of the plug 91*a*.

As shown in the FIGS. 13, 14, 15A and 15B, FIG. 14 is an exploded perspective view of the fourth preferred embodiment of the present invention. The difference of this embodiment from the first embodiment illustrated in FIG. 1 is that the lower beam 7 has a coupling means 8*a,* a coupling means 8*b,* a coupling means 8*c* and a coupling means 8*d* which are coupled thereon. The other pants are identical.

In the lower beam 7, the coupling means 8*a* and coupling means 8*b* are formed as a set and have an upper left panel 8*a*1, a flange 8*a*11, a stopper 8*a*12, an upper right panel 8*a*2, a flange 8*a*21, a stopper 8*a*22, a middle plate 8*a*3, a bottom plate 8*a*4, a hole 8*a*41, a hole 8*a*5, a plug 8*a*6, a groove 8*a*61, a groove 8*a*62, a flange 8*b*21, a stopper 8*b*22, at middle plate 8*b*3, at bottom plate 8*b*4, a hole 8*b*41, a hole 8*b*5, a plug 8*b*6, a groove 8*b*61, a groove 8*b*62, a pulley 810, a shaft 811, a pulley 820, a shaft 821, etc. The bottom of the lower beam 7 has a hole 713, a hole 723, a hole 733 and a hole 743 disposed in respective correspondence to the bottoms of the coupling means 8*a,* coupling means 8*b,* coupling means 8*c* and coupling means 8*d.* The shaft 811 and shaft 821 respectively pass through the pulley 810 and pulley 820 and then enter into the coupling means 8*a* and coupling means 8*b* along the space between the middle plates 8*a*3 and 8*b*3 and flanges 8*a*11 and 8*a*21 of the coupling mcans 8*a* and coupling means 8*b*. Then, they are retained in the selected positions in the coupling means 8*a* and coupling means 8*b* by the stopper 8*a*12, stopper 8*a*22, stopper 8*b*12, and stopper 8*b*22. The hole 713 and hole 723 are respectively disposed with respect to the hole 8*a*41 and hole 8*b*41 in the bottom plate 8*a*4 and bottom plate 8*b*4, at the bottoms of the coupling means 8*a* and coupling means 8*b*. The holes 713 and 723 and 8*a*41 and 8*b*41 respectively receive the plug 91 and the plug 92, to fix the ladder rope 11 and ladder rope 12 in the lower beam 7 and then fix the coupling means 8*a* and coupling means 8*b* on the lower beam 7. The rope 15 winds downwards through the right side of the pulley 820 and then passes upwards from the left side of the pulley 810. The upper left panel 8*a*1, upper right panel 8*a*2, upper left panel 8*b*1, and upper right panel 8*b*2 can support the weight of the slat 6l, slat 62, slat 63, slat 64, slat 65 and slat 66 without deformation.

The coupling means 8*c* and coupling means 8*d* which are formed as another set have the same structure and principle as the set formed by the coupling means 8*a* and coupling means 8*b*.

Figure 20:
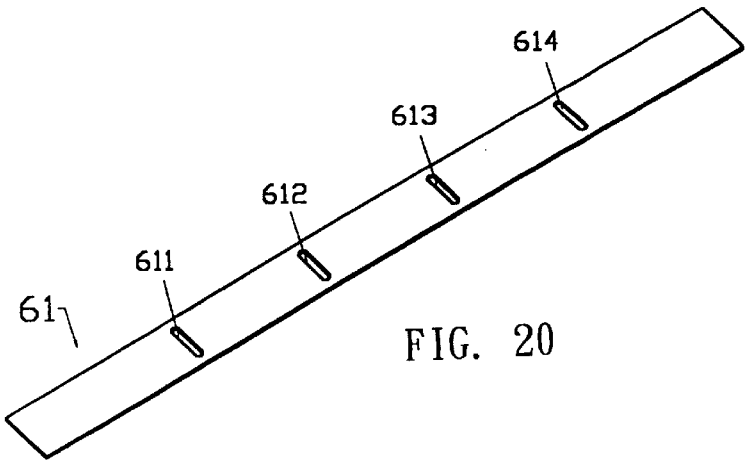
FIG. 20 is a schematic perspective view of one slat in the present invention.
Figure 16A:
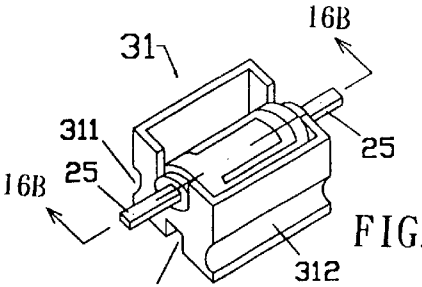
FIG. 16A is a perspective view of a winding box 31 of the present invention.
Figure 16B:
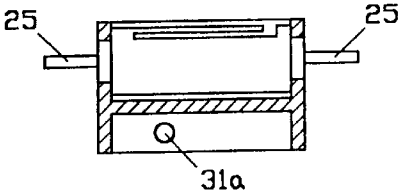
FIG. 16B is a schematic cross sectional view along line 16B—16B of the winding box 31 of FIG. 16A.
Figure 19A:
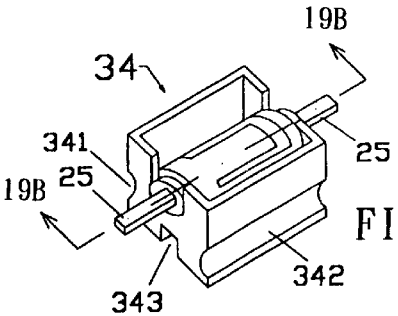
FIG. 19A is a perspective view of a winding box 34 of the present invention.
Figure 19B:
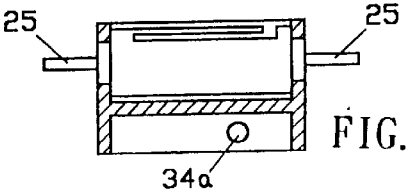
FIG. 19B is a schematic cross sectional view along line 19B—19B of the winding box 34 of FIG. 19A.

A schematic perspective view of tie slat 61 is illustrated in FIG. 20. The slat 61 has hole 611, hole 612, hole 613 and hole 614 which form channels for the rope 15 and rope 16. Similarly, the slat 62, slat 63, slat 64, slat 65, slat 66 have corresponding holes.

By the above structure of the present invention, and in its practical utilization, the number of winding boxes of each rope set can be changed with respect to the number of winding boxes in each product. If the number of winding boxes is six, then the first, second and third winding boxes are defined as one set, and the fourth, fifth and sixth winding boxes are defined as another set. The space for receiving the ropes can be installed in any space, such as the upper side or lower side or front side or the rear side of the upper beam. The constructions are identical to the previously described embodiment.

From the description of the present invention, as thus described, it will be obvious that the same may be varied in many ways. Such variations are not to be regarded as a departure from the spirit and scope of the present invention, and all such modifications as would be obvious to one killed in the art are intended to be included within the scope of the following claims.

What is claimed is:

1. A force reducing device for adjusting shutter ropes comprising:

an upper beam;

a pulley box coupled to one end of said upper beam, said pulley box including a first pulley rotatably mounted therein;

a rope retaining seat coupled to an opposing end of said upper beam, said rope retaining seat including a balance strip having outlets formed therein;

a slat angle drive mounted to said upper beam and having a link shaft extending therefrom;

a plurality of winding boxes mounted to said upper beam and respectively coupled to said link shaft, each of said winding boxes having a rolling shaft, said plurality of winding boxes being divided into two sets of winding boxes, said two sets of winding boxes being symmetrically disposed with respect to a center of said upper beam, a first of said two sets of winding boxes having a first rope fixed thereto and a second of said two sets of winding boxes having a second rope fixed thereto;

a lower beam having a plurality of second pulleys mounted therein, said lower beam having a plurality of holes formed therethrough;

a plurality of slats disposed between said upper beam and said lower beam and supported by a plurality of ladder ropes, each of said slats having a plurality of openings formed therethrough;

a third rope having one portion thereof passing through said rope retaining seat to extending through said upper beam and pass around said first pulley of said pulley box, said third rope having another portion extending from said first pulley back through said upper beam to pass back through said rope retaining seat; and, a fixing ring securing opposing ends of said third rope to form a continuous loop with a portion thereof having a predetermined length extending from said rope retaining seat, said first and second ropes respectively extending downwardly from a respective winding box of said two sets of winding boxes, said first and second ropes respectively passing through first corresponding openings of said plurality of slats to extend around a respective pair of said plurality of second pulleys and pass upwardly through second corresponding openings of said plurality of slats to extend over a respective one of said rolling shafts, said first and second ropes having respective end portions extending from said respective rolling shafts through corresponding outlets of said balance strip, said end portions of said first and second ropes being joined together with said opposing ends of said third rope by said fixing ring, wherein displacement of a length of said joined first, second and third ropes from said rope retaining seat to raise said lower beam is matched by a corresponding length of said third rope being displaced into said upper beam to thereby maintain said predetermined length of said portion of said continuous loop substantially unchanged.

2. The force reducing device for adjusting shutter ropes as recited in claim 1, wherein said lower beam is a tube having an elongated opening at an upper side thereof; a plurality of fixing shafts fixed to said lower beam respectively pass through said plurality of second pulleys; said lower beam having a plurality of holes formed through a bottom thereof; said force reducing device further comprising a plurality of plugs respectively inserted into said holes in said bottom of said lower beam for respectively fixing said plurality of ladder ropes to said lower beam.

3. The force reducing device for adjusting shutter ropes as recited in claim 1, wherein said lower beam is a tube having all elongated opening at a upper side thereof for said first and second ropes to pass therethrough, said lower beam including an enhancing spacer disposed adjacent a lower side of said elongated opening; a plurality of fixing shafts fixed to said lower beam through a plurality of small openings formed therein, said plurality of fixing shafts respectively pass through said plurality of second pulleys; said force reducing device further comprising a plurality of plugs respectively inserted into said holes in said bottom of said lower beam for respectively fixing said plurality of ladder ropes to said lower beam.

4. The force reducing device for adjusting shutter ropes as recited in claim 1, wherein said slat angle drive and each of said winding boxes have guide grooves formed in opposing sides thereof for respective portions of said third rope to extend therethrough.

5. A force reducing device for adjusting shutter ropes comprising:

an upper beam;

a pulley box coupled to one end of said upper beam, said pulley box including a first pulley rotatably mounted therein;

a rope retaining seat coupled to an opposing end of said upper beam, said rope retaining seat including a balance strip having outlets formed therein;

a slat angle drive mounted to said upper beam and having a link shaft extending therefrom;

a plurality of winding boxes mounted to said upper beam and respectively coupled to said link shaft, each of said winding boxes having a rolling shaft, said plurality of winding boxes being divided into two sets of winding boxes, said two sets of winding boxes being symmetrically disposed with respect to a center of said upper beam, a first of said two sets of winding boxes having a first rope fixed thereto and a second of said two sets of winding boxes having a second rope fixed thereto;

a lower beam having a plurality of holes formed therethrough;

a plurality of couplings mounted to said lower beam in respective correspondence to said plurality of winding boxes, said plurality of couplings respectively having a plurality of second pulleys mounted thereto;

a plurality of slats disposed between said upper beam and said lower beam and supported by a plurality of ladder ropes, each of said slats having a plurality of openings formed therethrough;

a third rope having one portion thereof passing through said rope retaining seat to extending through said upper beam and pass around said first pulley of said pulley box, said third rope having another portion extending from said first pulley back through said upper beam to pass back through said rope retaining seat; and, a fixing ring securing opposing ends of said third rope to form a continuous loop with a portion thereof having a predetermined length extending from said rope retaining seat, said first and second ropes respectively extending downwardly from a respective winding box of said two sets of winding boxes, said first and second ropes respectively passing through first corresponding openings of said plurality of slats to extend around a respective pair of said plurality of second pulleys and pass upwardly through second corresponding openings of said plurality of slats to extend over a respective one of said rolling shafts, said first and second ropes having respective end portions extending from said respective rolling shafts through corresponding outlets of said balance strip, said end portions of said first and second ropes being joined together with said opposing ends of said third rope by said fixing ring, wherein displacement of a length of said joined first, second and third ropes from said rope retaining seat to raise said lower beam is matched by a corresponding length of said third rope being displaced into said upper beam to thereby maintain said predetermined length of said portion of said continuous loop substantially unchanged.

6. The force reducing device for adjusting shutter ropes as recited in claim 5, wherein each of said plurality of couplings are formed by a short tube having an elongated opening at an upper side thereof of passage of a respective one of said first and second ropes therethrough, each said coupling having a bottom with a hole formed therethrough in correspondence to a respective hole formed through a bottom of said lower beam; said force reducing device further comprising a plurality of plugs respectively inserted into said holes in said bottom of said couplings and said bottom of said lower beam for respectively fixing said plurality of ladder ropes to said lower beam.

7. The force reducing device for adjusting shutter ropes as recited in claim 5, wherein each of said plurality of couplings are formed by a short tube having an elongated opening at an upper side thereof of passage of a respective one of said first and second ropes therethrough, each said coupling having a bottom with a hole formed therethrough in correspondence to a respective hole formed through a bottom of said lower beam; said force reducing device further comprising a plurality of plugs respectively inserted into said holes in said bottom of said couplings and said bottom of said lower beam for respectively fixing said plurality of ladder ropes to said lower beam; each of said couplings including a fixing shaft secured thereto and passing through said second pulley thereof.

8. The force reducing device for adjusting shutter ropes as recited in claim 5, wherein said slat angle drive and each of said winding boxes have guide grooves formed in opposing sides thereof for respective portions of said third rope to extend therethrough.

9. A force reducing method for adjusting shutter ropes, comprising the step of:

providing an upper beam;

coupling a pulley box having a first pulley, a slat angle drive, a plurality of winding boxes, and a rope retaining seat to said upper beam, each of said plurality of winding boxes including a rolling shaft and said rope retaining seat including a balance strip;

dividing said plurality of winding boxes into two sets and mounting said two sets of winding boxes symmetrically with respect to a center of said upper beam;

coupling a first rope to a first of said sets of winding boxes and coupling a second rope to a second of said sets of winding boxes;

providing a lower beam having a plurality of holes and a plurality of second pulleys;

providing a plurality of slats disposed between said upper beam and said lower beam and supported by a plurality of ladder ropes, each of said slats having a plurality of openings formed therethrough;

respectively passing said first and second ropes downwardly through corresponding openings of said slats;

respectively winding said first and second ropes around corresponding pain of said plurality of second pulleys;

respectively passing said first and second ropes upwardly through other corresponding openings of said slates;

respectively winding said first and second ropes over corresponding ones of said rolling shafts and passing respective ends of said first and second ropes through corresponding outlets of said balance strip;

providing a third rope;

passing one portion of said third rope through said rope retaining seat to extend through said upper beam and pass around said first pulley of said pulley box;

passing another portion of said third rope extending from said first pulley back through said upper beam to pass back through said rope retaining seat; and, joining opposing ends of said third loop together to form a continuous loop and joining said ends of said first and second ropes to said continuous loop, wherein displacement of a length of a first portion of said continuous loop to displace said first and second ropes from said rope retaining seat for raising said lower beam is matched by a corresponding length of another portion of said continuous loop being displaced into said upper beam to thereby maintain a predetermined length of said first portion of said continuous loop substantially unchanged.

* * * * *